US009947273B2

(12) United States Patent
Meng et al.

(10) Patent No.: US 9,947,273 B2
(45) Date of Patent: Apr. 17, 2018

(54) VOLTAGE DROP COMPENSATION METHOD, VOLTAGE DROP COMPENSATION DEVICE, AND DISPLAY DEVICE

(71) Applicant: BOE TECHNOLOGY GROUP CO., LTD., Beijing (CN)

(72) Inventors: Song Meng, Beijing (CN); Danna Song, Beijing (CN); Yang Zhou, Beijing (CN); Fei Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/220,080

(22) Filed: Jul. 26, 2016

(65) Prior Publication Data

US 2017/0193905 A1 Jul. 6, 2017

(30) Foreign Application Priority Data

Jan. 4, 2016 (CN) ..... 2016 1 0003609

(51) Int. Cl.
*G09G 3/3258* (2016.01)

(52) U.S. Cl.
CPC ..... *G09G 3/3258* (2013.01); *G09G 2300/043* (2013.01); *G09G 2300/0452* (2013.01); *G09G 2320/0233* (2013.01)

(58) Field of Classification Search
CPC ..... G09G 3/3258; G09G 2320/0233; G09G 2300/043; G09G 2300/0452
See application file for complete search history.

(56) References Cited

U.S. PATENT DOCUMENTS 9,431,903 B2 * 8/2016 Kwon ..... H02M 3/158
9,679,519 B2 * 6/2017 Lebrun ..... G09G 3/3258
2005/0001792 A1 1/2005 Watanabe et al.
(Continued)

FOREIGN PATENT DOCUMENTS

CN 103996374 A 8/2014
CN 104537985 A 4/2015
(Continued)

OTHER PUBLICATIONS

First Office Action regarding Chinese Application No. 201610003609.3, dated Jul. 13, 2017. Translation provided by Dragon Intellectual Property Law Firm.

*Primary Examiner* — Andrew Sasinowski
(74) *Attorney, Agent, or Firm* — Harness, Dickey & Pierce, P.L.C.

(57) ABSTRACT

The present disclosure provides a voltage drop compensation method, a voltage drop compensation device and a display device. The voltage drop compensation method includes steps of determining a voltage drop for a power signal corresponding to each subpixel set; determining a first equivalent brightness reduction value corresponding to the voltage drop; calculating an initial brightness value for each subpixel in the subpixel set; calculating a sum of the first equivalent brightness reduction value corresponding to the subpixel set and the initial brightness value as a target brightness value for each subpixel in the subpixel set; and generating a driving signal for each subpixel in accordance with the target brightness value for each subpixel in the subpixel set, and outputting the driving signal.

16 Claims, 4 Drawing Sheets

(56) References Cited

U.S. PATENT DOCUMENTS

| | | | | |
|---|---|---|---|---|
| 2012/0236041 | A1 | 9/2012 | Oh | |
| 2012/0248514 | A1 | 10/2012 | Korekado et al. | |
| 2015/0269887 | A1* | 9/2015 | Liu ..... | G09G 3/3291 345/212 |
| 2017/0140705 | A1 | 5/2017 | Xu et al. | |
| 2017/0148382 | A1 | 5/2017 | Kuo et al. | |
| 2017/0162124 | A1 | 6/2017 | Kuo | |

FOREIGN PATENT DOCUMENTS

| | | | |
|---|---|---|---|
| CN | 104821152 | A | 8/2015 |
| CN | 104867455 | A | 8/2015 |

* cited by examiner

VOLTAGE DROP COMPENSATION METHOD, VOLTAGE DROP COMPENSATION DEVICE, AND DISPLAY DEVICE

CROSS-REFERENCE TO RELATED APPLICATION

The present application claims a priority of the Chinese Patent Application No.201610003609.3 filed on Jan. 4, 2016, which is incorporated herein by reference in its entirety.

TECHNICAL FIELD

The present disclosure relates to the field of display technology, in particular to a voltage drop compensation method, a voltage drop compensation device and a display device.

BACKGROUND

Organic Light-Emitting Diode (OLED) display devices have been considered as the display devices with the greatest potential due to their advantages such as self-luminescence, low driving voltage, high light-emitting efficiency, rapid response speed, high definition and contrast, a wide viewing angle of about 180°, a wide operating temperature range, and being capable of achieving flexible display as well as large-area full-color display.

Along with the development of the technology, Active Matrix Organic Light-Emitting Diode (AMOLED) display device with a large size and a high resolution have been widely used. For the AMOLED display device, an identical power voltage (VDD) is applied to all subpixels. However, a voltage drop (IR drop) may inevitably occur due to a wire resistance in the case that a VDD signal is transmitted on a wire, so the actual power voltages applied to the subpixels may be different from each other. At this time, the subpixels may emit light at different brightness values in the case of an identical data signal, resulting in uneven display brightness.

In addition, in the case of image change, the voltage drop may change along with a driving current.

For a conventional display driver circuit, the voltage drop compensation is performed on a subpixel basis. Taking a mainstream ultra high definition display panel with a resolution of 3840*2160 as an example, compensation amounts for about 10,000,000 (8,294,400 exactly) subpixels may be calculated within one frame (a dozen of milliseconds). To be specific, for each subpixel, at least of the following items need to be calculated: a current ideal current for the subpixel, a VDD voltage drop corresponding to the current, a brightness reduction amount due to the VDD voltage drop, a data signal compensation amount for compensating for the brightness reduction amount, and a data signal after the compensation.

It is found that, the calculation burden is extremely large in the case that the voltage drop compensation is performed for each subpixel, and it is impossible for the conventional display driver circuit to achieve the large-scale application.

SUMMARY

An object of the present disclosure is to provide a voltage drop compensation method, a voltage drop compensation device and a display device, so as to reduce the calculation burden for the voltage drop compensation, thereby to compensate for the voltage drop in an accurate and fast manner.

In one aspect, the present disclosure provides in some embodiments a voltage drop compensation method for a display panel. The display panel includes a power line connected to a power signal input end and a plurality of subpixels connected to the power line and driven simultaneously, and the plurality of subpixels is segmented into at least two subpixel sets without any intersection in an ascending order of distances between the subpixels and the power signal input end. The voltage drop compensation method includes steps of: determining a voltage drop for a power signal corresponding to each subpixel set; determining a first equivalent brightness reduction value corresponding to the voltage drop; calculating an initial brightness value for each subpixel in the subpixel set; calculating a sum of the first equivalent brightness reduction value corresponding to the subpixel set and the initial brightness value as a target brightness value for each subpixel in the subpixel set; and generating a driving signal for each subpixel in accordance with the target brightness value for each subpixel in the subpixel set, and outputting the driving signal.

Alternatively, each subpixel set includes subpixels in different colors and at least two subpixels in an identical color. The step of determining the first equivalent brightness reduction value corresponding to the voltage drop includes: determining a second equivalent brightness reduction value corresponding to the voltage drop for each subpixel subset in the subpixel set, each subpixel subset including the subpixels in an identical color. The step of calculating the target brightness value for each subpixel in the subpixel set includes: calculating a sum of the second equivalent brightness reduction value corresponding to each subpixel subset and the initial brightness value for each subpixel as the target brightness value for each subpixel in each subpixel subset.

Alternatively, the voltage drop $\Delta V_n$ for the power signal corresponding to an $n^{th}$ pixel set is calculated using an equation:

$$\Delta V_n = \begin{cases} \Delta V_{n-1} + R_n * \sum_{i=n}^{N} L_i / K & 2 \le n \le N \\ R_1 * \sum_{i=1}^{N} L_i / K & n = 1 \end{cases},$$

where N represents the number of the subpixel sets, $\Delta V_{n-1}$ represents the voltage drop for the power signal corresponding to an $(n-1)^{th}$ subpixel set adjacent to the $n^{th}$ subpixel set and closer to the power signal input end, $R_n$ represents a resistance of a portion of the power line connected to the $n^{th}$ subpixel set, $L_i$ represents a brightness value for an $i^{th}$ subpixel set which is a sum of the brightness values for all subpixels in the subpixel set, and K represents a ratio of the brightness value for each subpixel to a driving current for each subpixel.

Alternatively, each subpixel includes an OLED and a driving thin film transistor (TFT) connected to the OLED. The step of determining the first equivalent brightness reduction value corresponding to the voltage drop includes: determining a first equivalent gate-to-source voltage $V_{GS}$ corresponding to each subpixel set; determining a first correspondence between a drain-to-source voltage $V_{DS}$ and a driving current $I_{DS}$ corresponding to the first equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the driving TFT; determining a first equivalent driving current reduction value corresponding to the voltage drop in accordance with the first correspondence; and determining the first equivalent brightness reduction value in accordance with the first equivalent driving current reduction value.

Alternatively, the first equivalent gate-to-source voltage VGS is an average of the gate-to-source voltages of all subpixels in each subpixel set.

Alternatively, each subpixel includes an OLED and a driving TFT connected to the OLED. The step of determining the second equivalent brightness reduction value for each subpixel subset in the subpixel set corresponding to the voltage drop includes: determining a second equivalent gate-to-source voltage $V_{GS}$ corresponding to each subpixel subset; determining a second correspondence between a drain-to-source voltage $V_{DS}$ and a driving current $I_{DS}$ corresponding to the second equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the driving TFT; determining a second equivalent driving current reduction value for each subpixel subset corresponding to the voltage drop in accordance with the second correspondence; and determining the second equivalent brightness reduction value for each subpixel subset corresponding to the voltage drop in accordance with the second equivalent driving current reduced value for each subpixel subset.

Alternatively, the second equivalent gate-to-source voltage $V_{GS}$ is an average of the gate-to-source voltages of all the subpixels in the subpixel subset.

In another aspect, the present disclosure provides in some embodiments a voltage drop compensation device for driving a display panel. The display panel includes a power line connected to a power signal input end and a plurality of subpixels connected to the power line and driven simultaneously, and the plurality of subpixels is segmented into at least two subpixel sets without any intersection in an ascending order of distances between the subpixels and the power signal input end. The voltage drop compensation device includes: a first determination module configured to determine a voltage drop for a power signal corresponding to each subpixel set; a second determination module configured to determine a first equivalent brightness reduction value corresponding to the voltage drop; an initial brightness calculation module configured to calculate an initial brightness value for each subpixel in the subpixel set; a target brightness calculation module configured to calculate a sum of the first equivalent brightness reduction value corresponding to the subpixel set and the initial brightness value as a target brightness value for each subpixel in the subpixel set; and a driving module configured to generate a driving signal for each subpixel in accordance with the target brightness value for each subpixel in the subpixel set, and output the driving signal.

Alternatively, each subpixel set includes subpixels in different colors and at least two subpixels in an identical color. The second determination module is further configured to determine a second equivalent brightness reduction value corresponding to the voltage drop for each subpixel subset in the subpixel set, each subpixel subset including the subpixels in an identical color. The target brightness calculation module is further configured to calculate a sum of the second equivalent brightness reduction value corresponding to each subpixel subset and the initial brightness value for each subpixel as the target brightness value for each subpixel in each subpixel subset.

Alternatively, the voltage drop $\Delta V_n$ for the power signal corresponding to an $n^{th}$ pixel set is calculated using an equation:

$$\Delta V_n = \begin{cases} \Delta V_{n-1} + R_n * \sum_{i=n}^{N} L_i / K & 2 \le n \le N \\ R_1 * \sum_{i=1}^{N} L_i / K & n = 1 \end{cases},$$

where N represents the number of the subpixel sets, $\Delta V_{n-1}$ represents the voltage drop for the power signal corresponding to an $(n-1)^{th}$ subpixel set adjacent to the $n^{th}$ subpixel set and closer to the power signal input end, $R_n$ represents a resistance of a portion of the power line connected to the $n^{th}$ subpixel set, $L_i$ represents a brightness value for an $i^{th}$ subpixel set which is a sum of the brightness values for all subpixels in the subpixel set, and K represents a ratio of the brightness value for each subpixel to a driving current for each subpixel.

Alternatively, each subpixel includes an OLED and a driving thin film transistor (TFT) connected to the OLED. The second determination module includes: a first unit configured to determine a first equivalent gate-to-source voltage $V_{GS}$ corresponding to each subpixel set; a second unit configured to determine a first correspondence between a drain-to-source voltage $V_{DS}$ and a driving current $I_{DS}$ corresponding to the first equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the driving TFT; a third unit configured to determine a first equivalent driving current reduction value corresponding to the voltage drop in accordance with the first correspondence; and a fourth unit configured to determine the first equivalent brightness reduction value in accordance with the first equivalent driving current reduction value.

Alternatively, each subpixel includes an OLED and a TFT connected to the OLED. The second determination module includes: a first unit configured to determine a second equivalent gate-to-source voltage $V_{GS}$ corresponding to each subpixel subset; a second unit configured to determine a second correspondence between a drain-to-source voltage $V_{DS}$ and a driving current $I_{DS}$ corresponding to the second equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the driving TFT; a third unit configured to determine a second equivalent driving current reduction value for each subpixel subset corresponding to the voltage drop in accordance with the second correspondence; and a fourth unit configured to determine the second equivalent brightness reduction value for each subpixel subset corresponding to the voltage drop in accordance with the second equivalent driving current reduced value for each subpixel subset.

In yet another aspect, the present disclosure provides in some embodiments a display device including the above-mentioned voltage drop compensation device.

According to the voltage drop compensation method, the voltage drop compensation device and the display device in the embodiments of the present disclosure, through determining the voltage drop for the power signal corresponding to each subpixel set, determining the first equivalent brightness reduction value corresponding to the voltage drop, calculating the initial brightness value for each subpixel in the subpixel set, calculating the sum of the first equivalent brightness reduction value and the initial brightness value corresponding to the subpixel set as the target brightness value for each subpixel in the subpixel set, generating the target brightness value for each subpixel in the subpixel set and outputting the driving signal for each subpixel, it is able to reduce the calculation burden for the voltage drop compensation, thereby to compensate for the voltage drop in an accurate and fast manner.

BRIEF DESCRIPTION OF THE DRAWINGS

In order to illustrate the technical solutions of the present disclosure or the related art in a clearer manner, the drawings desired for the present disclosure or the related art will be described hereinafter briefly. Obviously, the following drawings merely relate to some embodiments of the present disclosure, and based on these drawings, a person skilled in the art may obtain the other drawings without any creative effort.

DETAILED DESCRIPTION OF THE EMBODIMENTS

In order to make the objects, the technical solutions and the advantages of the present disclosure more apparent, the present disclosure will be described hereinafter in a clear and complete manner in conjunction with the drawings and embodiments. Obviously, the following embodiments merely relate to a part of, rather than all of, the embodiments of the present disclosure, and based on these embodiments, a person skilled in the art may, without any creative effort, obtain the other embodiments, which also fall within the scope of the present disclosure.

Unless otherwise defined, any technical or scientific term used herein shall have the common meaning understood by a person of ordinary skills. Such words as "first" and "second" used in the specification and claims are merely used to differentiate different components rather than to represent any order, number or importance. Similarly, such words as "one" or "one of" are merely used to represent the existence of at least one member, rather than to limit the number thereof. Such words as "connect" or "connected to" may include electrical connection, direct or indirect, rather than to be limited to physical or mechanical connection. Such words as "on", "under", "left" and "right" are merely used to represent relative position relationship, and when an absolute position of the object is changed, the relative position relationship will be changed too.

Figure 1:
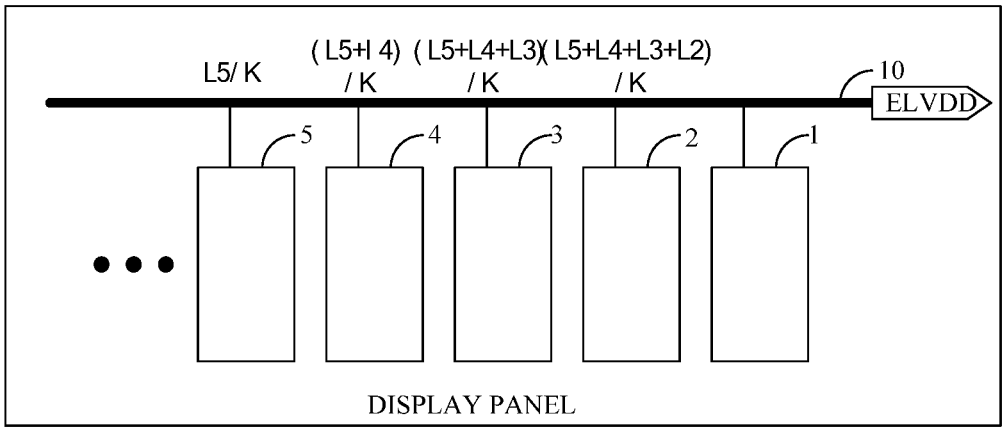
FIG. 1 is a schematic view showing a display panel where voltage drop compensation needs to be performed according to one embodiment of the present disclosure.

The present disclosure provides in some embodiments a voltage drop compensation method for a display panel, e.g., an AMOLED display panel. As shown in FIG. 1, the display panel may include a power line 10 connected to a power signal input end (ELVDD) and a plurality of subpixels connected to the power line 10 and driven simultaneously.

In order to facilitate the implementation of the voltage drop compensation method, in the embodiments of the present disclosure, the display panel may be segmented into various regions, e.g., the plurality of subpixels may be segmented into at least two subpixel sets without any intersection in an ascending order of distances between the subpixels and the power signal input end. The voltage drop compensation may be performed on a subpixel set basis, i.e., the voltage drop compensation may be performed on the subpixels in an identical subpixel set using an identical compensation parameter. As a result, it is able to reduce the calculation burden for the voltage drop compensation while ensuring the display quality and the calculation accuracy.

For the display panel, the more the subpixel sets, the more complex the calculation, and the more accurate the calculation. In contrast, the fewer the subpixel sets, the simpler the calculation, and the less accurate the calculation. For ease of understanding, the description will be given subsequently by segmenting the subpixels into five subpixel sets (e.g., subpixel sets 1, 2, 3, 4 and 5 in FIG. 1).

In FIG. 1, the power line 10 is located at a right side of the display panel and configured to drive the subpixels in the five subpixel sets simultaneously.

The voltage drop compensation method for the display panel in FIG. 1 will be described hereinafter in more details.

Figure 2:
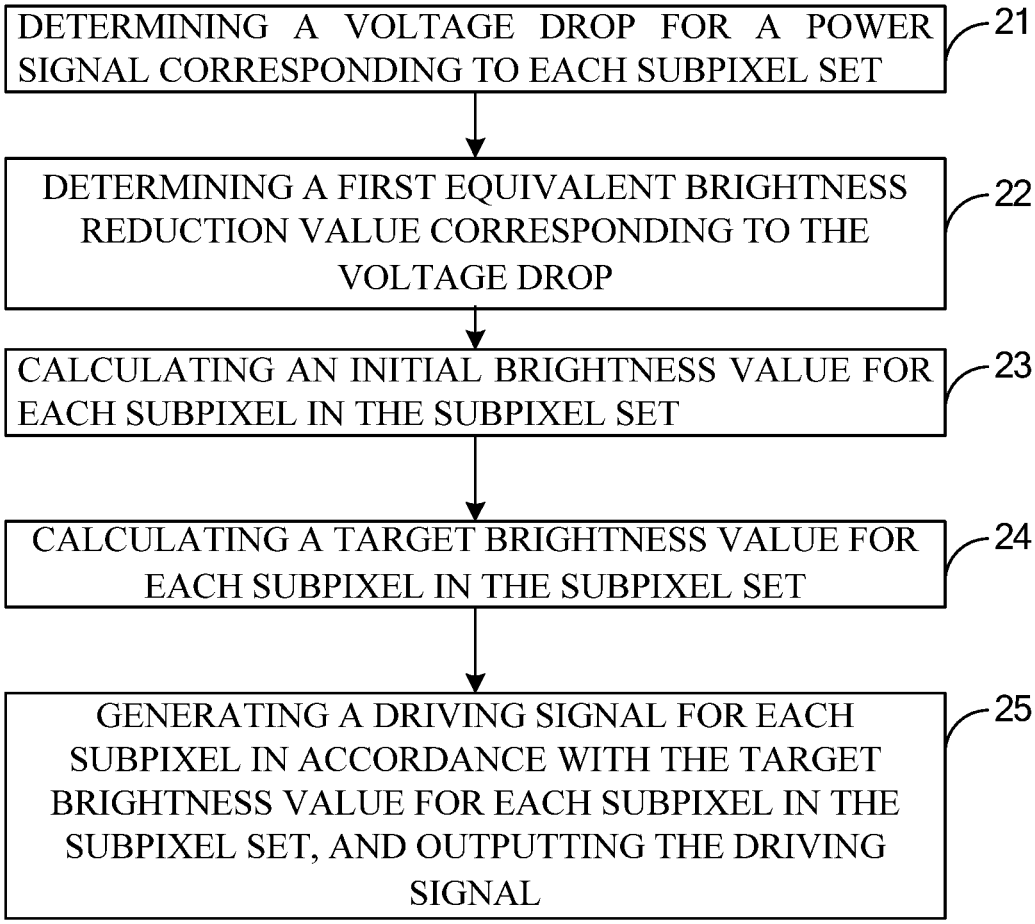
FIG. 2 is a flow chart of a voltage drop compensation method according to one embodiment of the present disclosure.

As shown in FIG. 2, the voltage drop compensation method may include the following steps.

Step 21: determining a voltage drop for a power signal corresponding to each subpixel set.

In the embodiments of the present disclosure, the voltage drop $\Delta V_n$ for the power signal corresponding to an $n^{th}$ pixel set may be calculated using an equation (1):

$$\Delta V_n = \begin{cases} \Delta V_{n-1} + R_n * \sum_{i=n}^{N} L_i / K & 2 \le n \le N \\ R_1 * \sum_{i=1}^{N} L_i / K & n = 1 \end{cases},$$

where N represents the number of the subpixel sets, $\Delta V_{n-1}$ represents the voltage drop for the power signal corresponding to an $(n-1)^{th}$ subpixel set adjacent to the $n^{th}$ subpixel set and closer to the power signal input end, $R_n$ represents a resistance of a portion of the power line 10 connected to the $n^{th}$ subpixel set (i.e., a resistance of the power line 10 between two adjacent subpixel sets), $L_i$ represents a brightness value for an $i^{th}$ subpixel set which is a sum of the brightness values for all subpixels in the subpixel set, and K represents a ratio of the brightness value for each subpixel to a driving current $I_i$ for each subpixel.

In the embodiments of the present disclosure, a grayscale value of each subpixel may be converted into a relative brightness value using an equation $L_i=(GL/1023)^{2.2}$, especially by looking up a table. Then, based on the brightness value, a corresponding light-emitting current may be calculated using an equation $I_i=L_i/K$, and then a current flowing through each subpixel set may be calculated, e.g., L1/K and (L1+L2)/K in FIG. 1. In this way, in the case that the resistance of the power line 10 between two subpixel set is R, it able to calculate a voltage drop for each segment of the power line 10 and determine a voltage ($E_i$) for each subpixel set, thereby to determine the voltage drop of the voltage relative to a power voltage E.

For the display panel in FIG. 1, because the first subpixel set 1 is arranged immediately close to the power signal input end, its voltage drop will not be taken into consideration. At this time, the voltage drop $\Delta V_2$ for the second subpixel set 2 may be calculated using an equation (2):

$$\Delta V_2 = R_2 * \frac{L2 + L3 + L4 + L5}{K},$$

where L2, L3, L4 and L5 represent a brightness value for the second subpixel set 2, a brightness value for the third subpixel set 3, a brightness value for the fourth subpixel set 4 and a brightness value for the fourth subpixel set 5 respectively, and each brightness value is a sum of the brightness values for all the subpixels in the corresponding subpixel set.

The voltage drop $\Delta V_3$ for the third subpixel set 3 may be calculated using an equation (3):

$$\Delta V_3 = \Delta V_2 + R_3 * \frac{L3 + L4 + L5}{K}.$$

In the case that $R_2=R_3$, the equation (2) may be substituted into the equation (3), so as to acquire an equation $$\Delta V_3 = R_3 * \frac{L2 + 2L3 + 2L4 + 2L5}{K}.$$

Similarly, an equation (4)

$$\Delta V_4 = R_4 * \frac{L2 + 2L3 + 3L4 + 3L5}{K}$$

and an equation (5)

$$\Delta V_5 = R_5 * \frac{L2 + 2L3 + 3L4 + 4L5}{K}$$

may be acquired.

Figure 3:
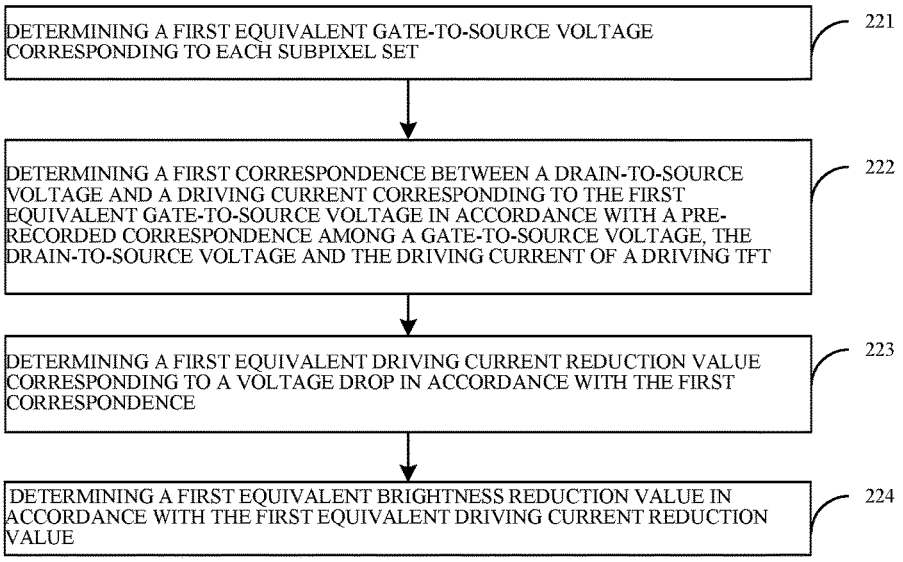
FIG. 3 is another flow chart of the voltage drop compensation method according to one embodiment of the present disclosure.

Step 22: determining a first equivalent brightness reduction value corresponding to the voltage drop. As shown in FIG. 3, Step 22 may include the following steps.

Step 221: determining a first equivalent gate-to-source voltage $V_{GS}$ corresponding to each subpixel set. Here, the first equivalent gate-to-source voltage $V_{GS}$ may be a gate-to-source voltage of a driving TFT (not shown) connected to an OLED of each subpixel. Alternatively, the first equivalent gate-to-source voltage $V_{GS}$ is an average of the gate-to-source voltages of all the subpixels in each subpixel set.

Step 222: determining a first correspondence between a drain-to-source voltage $V_{DS}$ and a driving current $I_{DS}$ corresponding to the first equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the driving TFT.

Step 223: determining a first equivalent driving current reduction value corresponding to the voltage drop in accordance with the first correspondence.

Step 224: determining the first equivalent brightness reduction value in accordance with the first equivalent driving current reduction value.

Figure 4:
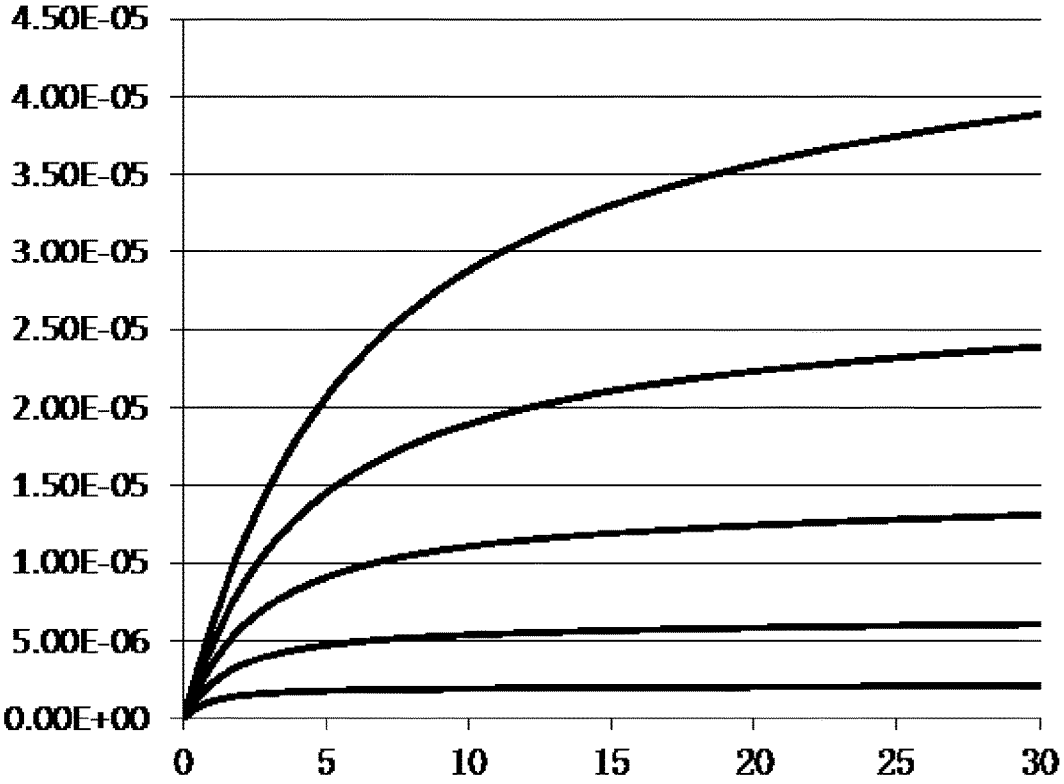
FIG. 4 is a diagram of $I_{DS}$-$V_{Ds}$ curves for the voltage drop compensation method according to one embodiment of the present disclosure.

In the embodiments of the present disclosure, the first correspondence may be a slope X of a drain-to-source voltage $V_{DS}$-driving current $I_{DS}$ curve. As shown in FIG. 4 (which shows the $I_{DS}$-$V_{DS}$ curves for the driving TFT in the case of different $V_{GS}$), at a saturation region for each $I_{DS}$-$V_{DS}$ curve, there is an approximate linear relationship between a current value and a voltage value, merely with different curvatures for different $V_{GS}$. In the case of a constant voltage drop $\Delta V_n$ and a constant slope X, it is able to determine the driving current $I_{DS}$, and then it is able to determine the brightness reduction value using a conversion equation between the driving current $I_{DS}$ and the brightness value L, e.g., $I_i=L_i/K$.

Taking the second subpixel set 2 in FIG. 1 as an example, the first equivalent brightness reduction value $\Delta L_2$ for the second subpixel set 2 may be calculated using an equation (6)

$$\begin{aligned}\Delta L_2 &= \Delta V_2 * X_2 * K \\ &= \frac{L2 + L3 + L4 + L5}{K} * R_2 * X_2 * K \\ &= (L2 + L3 + L4 + L5) * R_2 * X_2.\end{aligned}$$

Step 23: calculating an initial brightness value for each subpixel in the subpixel set. To be specific, the initial brightness value for each subpixel may be determined in accordance with a grayscale value for the subpixel, especially by looking up a table. After the initial brightness value has been determined after looking up the table, it may be stored for the subsequent use.

Step 24: calculating a target brightness value for each subpixel in the subpixel set. To be specific, the target brightness value may be a sum of the first equivalent brightness reduction value $\Delta L_i$ corresponding to the subpixel set and the initial brightness value.

Step 25: generating a driving signal for each subpixel in accordance with the target brightness value for each subpixel in the subpixel set, and outputting the driving signal. To be specific, the target brightness value for each subpixel in the subpixel set may be converted into a grayscale value. Then, the driving signal may be determined in accordance with the grayscale value and outputted, so as to drive the subpixel to emit light in a color at the corresponding brightness value.

In an alternative embodiment of the present disclosure, in the case that a difference between the target brightness values for the subpixels at a boundary of the two adjacent subpixel sets is greater than a predetermined value, interpolation may be performed on the target brightness values for the subpixels, e.g., an average of the two target brightness values may be calculated. Then, the driving signal may be generated in accordance with the average, and then outputted, so as to drive several rows or columns of subpixels at the boundary of the two subpixel sets to emit light, thereby to achieve the smooth transition of the brightness between the two adjacent subpixel sets and ensure the display effect.

The above description is given in the case that the subpixels in each subpixel set emit light in an identical color. However, during the actual application, in the case that the subpixels in each subpixel set emit light in different colors, one problem may occur. Taking pure-color display as an example, in the case that red subpixels emit the red light at a high brightness value, ideally the other subpixels may not emit light. For all the subpixels in the subpixel set, the first equivalent brightness reduction value may be relatively large. At this time, after the voltage drop compensation has been performed for the other subpixels that shouldn't have emitted light in accordance with the large first equivalent brightness reduction value, these subpixels may emit light. However, in the case that the subpixels are segmented on a color basis, the equivalent brightness reduction value for the subpixels that shouldn't have emitted light may be relatively small. At this time, after the voltage drop compensation for these subpixels have been performed in accordance with the small equivalent brightness reduction value, the compensation amount may be just canceled out by the brightness reduction value due to the VDD drop, so these subpixels may be maintained in a state of not emitting light.

Hence, in an alternative embodiment of the present disclosure, the subpixels in each subpixel set may be segmented into subsets on a color basis, i.e., the voltage drop compensation may be performed for the subpixels in each subpixel set on a color basis.

To be specific, during the actual application, each subpixel set includes subpixels in different colors and at least two subpixels in an identical color.

Figure 5:
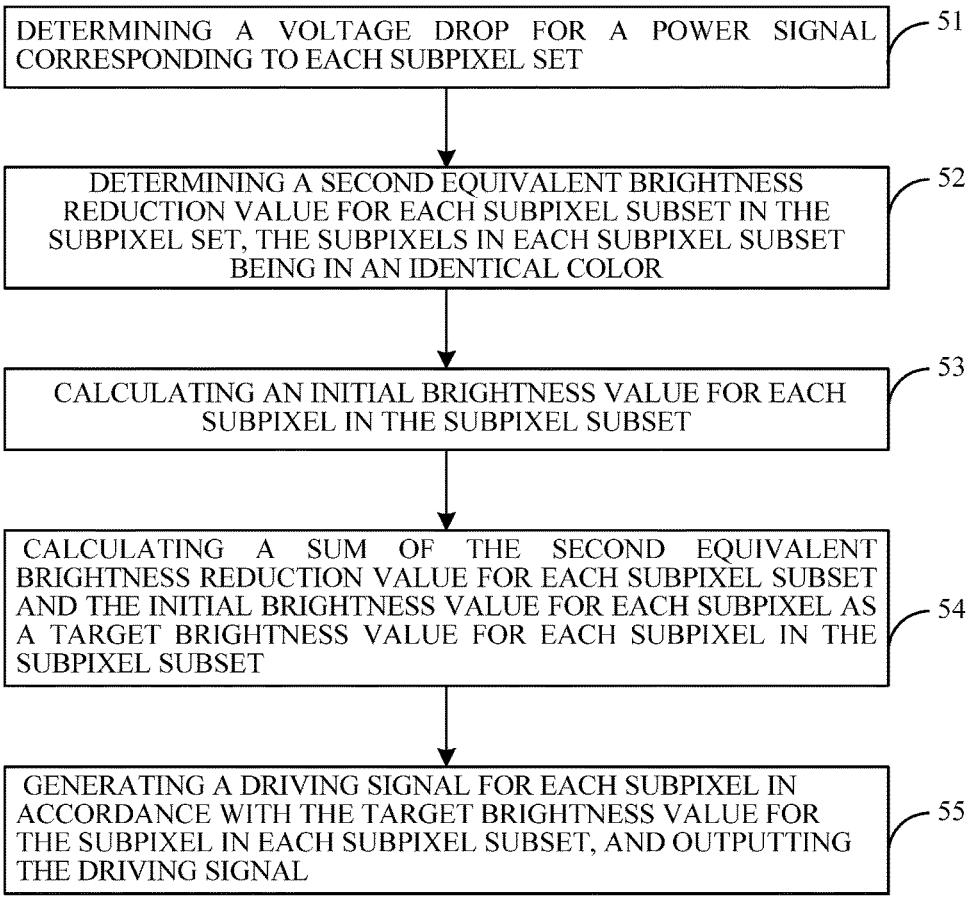
FIG. 5 is yet another flow chart of the voltage drop compensation method according to one embodiment of the present disclosure.

As shown in FIG. 5, the voltage drop compensation method may include: Step 51 of determining the voltage drop for the power signal corresponding to each subpixel set; Step 52 of determining a second equivalent brightness reduction value for each subpixel subset in the subpixel set, the subpixels in each subpixel subset being in an identical color; Step 53 of calculating the initial brightness value for each subpixel in the subpixel subset; Step 54 of calculating a sum of the second equivalent brightness reduction value for each subpixel subset and the initial brightness value for each subpixel as the target brightness value for each subpixel in the subpixel subset; and Step 55 of generating the driving signal for each subpixel in accordance with the target brightness value for the subpixel in each subpixel subset, and outputting the driving signal.

Figure 6:
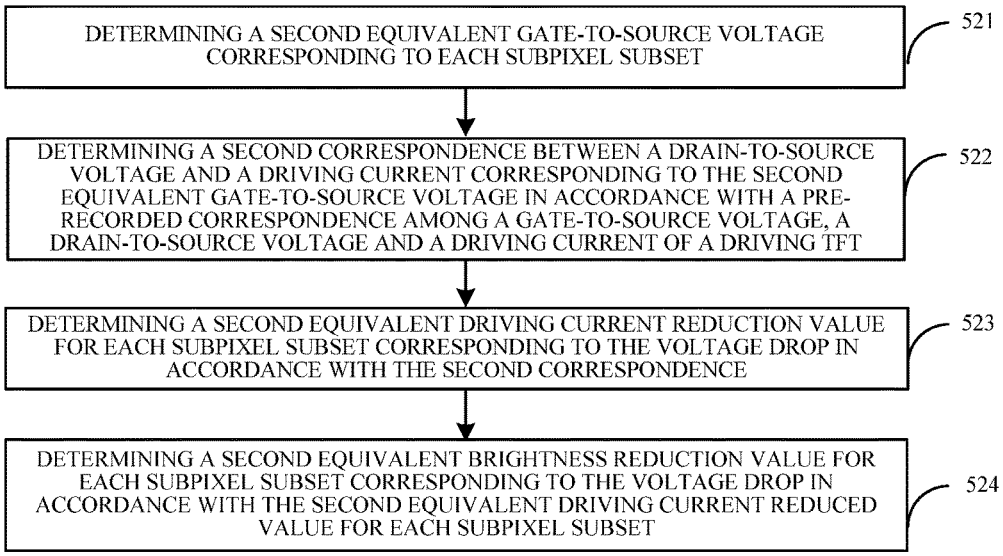
FIG. 6 is still yet another flow chart of the voltage drop compensation method according to one embodiment of the present disclosure.

As shown in FIG. 6, Step 52 may include: Step 521 of determining a second equivalent gate-to-source voltage $V_{GS}$ corresponding to each subpixel subset; Step 522 of determining a second correspondence between a drain-to-source voltage $V_{DS}$ and a driving current $I_{DS}$ corresponding to the second equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the driving TFT; Step 523 of determining a second equivalent driving current reduction value for each subpixel subset corresponding to the voltage drop in accordance with the second correspondence; and Step 524 of determining the second equivalent brightness reduction value for each subpixel subset corresponding to the voltage drop in accordance with the second equivalent driving current reduced value for each subpixel subset.

The second equivalent gate-to-source voltage $V_{GS}$ may be an average of the gate-to-source voltages of all the subpixels in each subpixel subset.

The procedures in FIGS. 5 and 6 are similar to those in FIGS. 2 and 3, and thus will not be particularly defined herein. Although with relatively large computation burden, it is able for the method in FIGS. 5 and 6 to perform, on a color basis, the voltage drop compensation for the subpixels in a more accurate manner.

The present disclosure further provides in some embodiments a voltage drop compensation device for driving a display panel. The display panel includes a power line connected to a power signal input end and a plurality of subpixels connected to the power line and driven simultaneously, and the plurality of subpixels is segmented into at least two subpixel sets without any intersection in an ascending order of distances between the subpixels and the power signal input end.

Figure 7:
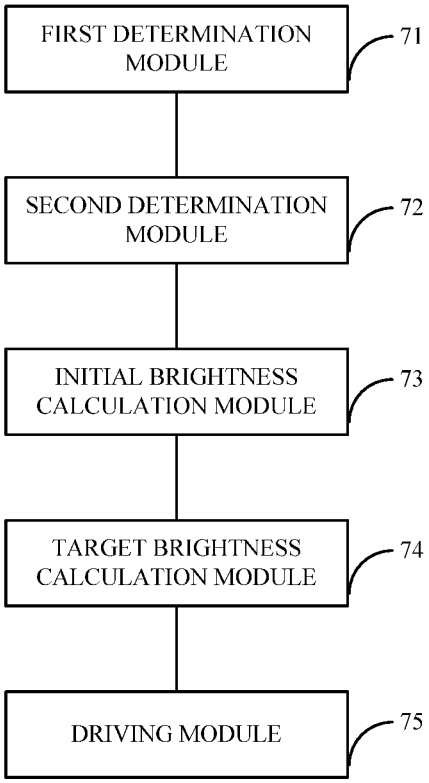
FIG. 7 is a schematic view showing a voltage drop compensation device according to one embodiment of the present disclosure.

As shown in FIG. 7, the voltage drop compensation device may include: a first determination module 71 configured to determine a voltage drop for a power signal corresponding to each subpixel set; a second determination module 72 configured to determine a first equivalent brightness reduction value corresponding to the voltage drop; an initial brightness calculation module 73 configured to calculate an initial brightness value for each subpixel in the subpixel set; a target brightness calculation module 74 configured to calculate a sum of the first equivalent brightness reduction value corresponding to the subpixel set and the initial brightness value as a target brightness value for each subpixel in the subpixel set; and a driving module 75 configured to generate a driving signal for each subpixel in accordance with the target brightness value for each subpixel in the subpixel set, and output the driving signal.

The modules in the embodiments of the present disclosure may be implemented by corresponding circuits.

Alternatively, each subpixel set includes subpixels in different colors and at least two subpixels in an identical color. The second determination module 72 is further configured to determine a second equivalent brightness reduction value corresponding to the voltage drop for each subpixel subset in the subpixel set, each subpixel subset including the subpixels in an identical color. The target brightness calculation module 74 is further configured to calculate a sum of the second equivalent brightness reduction value corresponding to each subpixel subset and the initial brightness value for each subpixel as the target brightness value for each subpixel in each subpixel subset.

Figure 8:
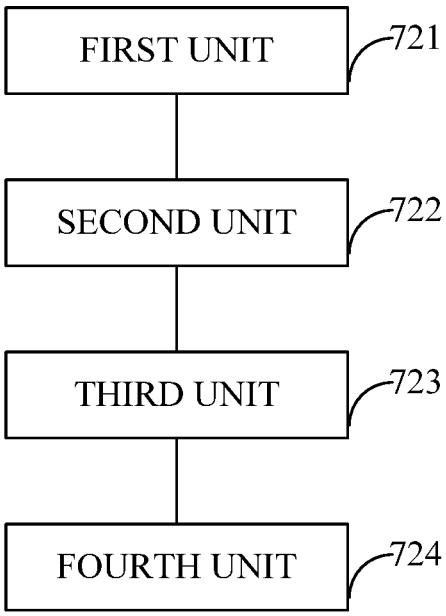
FIG. 8 is a schematic view showing a second determination module of the voltage drop compensation device according to one embodiment of the present disclosure.

In an alternative embodiment, as shown in FIG. 8, the second determination module 72 may include: a first unit 721 configured to determine a first equivalent gate-to-source voltage $V_{GS}$ corresponding to each subpixel set; a second unit 722 configured to determine a first correspondence between a drain-to-source voltage $V_{DS}$ and a driving current $I_{DS}$ corresponding to the first equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the driving TFT; a third unit 723 configured to determine a first equivalent driving current reduction value corresponding to the voltage drop in accordance with the first correspondence; and a fourth unit 724 configured to determine the first equivalent brightness reduction value in accordance with the first equivalent driving current reduction value.

In another alternative embodiment, the second determination module 72 may include: the first unit 721 configured to determine a second equivalent gate-to-source voltage $V_{GS}$ corresponding to each subpixel subset; the second unit 722 configured to determine a second correspondence between a drain-to-source voltage $V_{DS}$ and a driving current $I_{DS}$ corresponding to the second equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the driving TFT; the third unit 723 configured to determine a second equivalent driving current reduction value for each subpixel subset corresponding to the voltage drop in accordance with the second correspondence; and the fourth unit 724 configured to determine the second equivalent brightness reduction value for each subpixel subset corresponding to the voltage drop in accordance with the second equivalent driving current reduced value for each subpixel subset.

The present disclosure provides in some embodiments a display device including the above-mentioned voltage drop compensation device.

The above are merely the preferred embodiments of the present disclosure, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A voltage drop compensation method for a display panel, the display panel comprising a power line connected to a power signal input end and a plurality of subpixels connected to the power line and driven simultaneously, the plurality of subpixels being segmented into at least two subpixel sets without any intersection in an ascending order of distances between the subpixels and the power signal input end, the voltage drop compensation method comprising steps of:

determining a voltage drop for a power signal corresponding to each subpixel set;

determining a first equivalent brightness reduction value corresponding to the voltage drop;

calculating an initial brightness value for each subpixel in the subpixel set;

calculating a sum of the first equivalent brightness reduction value corresponding to the subpixel set and the initial brightness value as a target brightness value for each subpixel in the subpixel set; and generating a driving signal for each subpixel in accordance with the target brightness value for each subpixel in the subpixel set, and outputting the driving signal, wherein:

each subpixel set comprises subpixels in different colors and at least two subpixels in an identical color, the step of determining the first equivalent brightness reduction value corresponding to the voltage drop comprises determining a second equivalent brightness reduction value corresponding to the voltage drop for each subpixel subset in the subpixel set, each subpixel subset including the subpixels in an identical color, and the step of calculating the target brightness value for each subpixel in the subpixel set comprises calculating a sum of the second equivalent brightness reduction value corresponding to each subpixel subset and the initial brightness value for each subpixel as the target brightness value for each subpixel in each subpixel subset.

2. The voltage drop compensation method according to claim 1, wherein the voltage drop $\Delta V_n$ for the power signal corresponding to an $n^{th}$ pixel set is calculated using an equation:

$$\Delta V_n = \begin{cases} \Delta V_{n-1} + R_n * \sum_{i=n}^{N} L_i / K & 2 \le n \le N \\ R_1 * \sum_{i=1}^{N} L_i / K & n = 1 \end{cases}, \text{ and}$$

wherein N represents the number of the subpixel sets, $\Delta V_{n-1}$ represents the voltage drop for the power signal corresponding to an $(n-1)^{th}$ subpixel set adjacent to the $n^{th}$ subpixel set and closer to the power signal input end, $R_n$ represents a resistance of a portion of the power line connected to the $n^{th}$ subpixel set, $L_i$ represents a brightness value for an $i^{th}$ subpixel set which is a sum of the brightness values for all subpixels in the subpixel set, and K represents a ratio of the brightness value for each subpixel to a driving current for each subpixel.

3. The voltage drop compensation method according to claim 1, wherein:

each subpixel includes an Organic Light-Emitting Diode (OLED) and a driving thin film transistor (TFT) connected to the OLED, and the step of determining the first equivalent brightness reduction value corresponding to the voltage drop comprises:

determining a first equivalent gate-to-source voltage $V_{GS}$ corresponding to each subpixel set;

determining a first correspondence between a drain-to-source voltage $V_{DS}$ and a driving current $I_{DS}$ corresponding to the first equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the driving TFT;

determining a first equivalent driving current reduction value corresponding to the voltage drop in accordance with the first correspondence; and determining the first equivalent brightness reduction value in accordance with the first equivalent driving current reduction value.

4. The voltage drop compensation method according to claim 3, wherein the first equivalent gate-to-source voltage $V_{GS}$ is an average of the gate-to-source voltages of all subpixels in the subpixel set.

5. The voltage drop compensation method according to claim 1, wherein:

each subpixel comprises an Organic Light-Emitting Diode (OLED) and a driving thin film transistor (TFT) connected to the OLED, and the step of determining the second equivalent brightness reduction value for each subpixel subset in the subpixel set corresponding to the voltage drop comprises:

determining a second equivalent gate-to-source voltage $V_{GS}$ corresponding to each subpixel subset;

determining a second correspondence between a drain-to-source voltage $V_{DS}$ and a driving current $I_{DS}$ corresponding to the second equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the driving TFT;

determining a second equivalent driving current reduction value for each subpixel subset corresponding to the voltage drop in accordance with the second correspondence; and determining the second equivalent brightness reduction value for each subpixel subset corresponding to the voltage drop in accordance with the second equivalent driving current reduced value for each subpixel subset.

6. The voltage drop compensation method according to claim 5, wherein the second equivalent gate-to-source voltage $V_{GS}$ is an average of the gate-to-source voltages of all the subpixels in the subpixel subset.

7. A voltage drop compensation device for driving a display panel, the display panel comprising a power line connected to a power signal input end and a plurality of subpixels connected to the power line and driven simultaneously, the plurality of subpixels being segmented into at least two subpixel sets without any intersection in an ascending order of distances between the subpixels and the power signal input end, the voltage drop compensation device comprising:

a first determination module configured to determine a voltage drop for a power signal corresponding to each subpixel set;

a second determination module configured to determine a first equivalent brightness reduction value corresponding to the voltage drop;

an initial brightness calculation module configured to calculate an initial brightness value for each subpixel in the subpixel set;

a target brightness calculation module configured to calculate a sum of the first equivalent brightness reduction value corresponding to the subpixel set and the initial brightness value as a target brightness value for each subpixel in the subpixel set; and a driving module configured to generate a driving signal for each subpixel in accordance with the target brightness value for each subpixel in the subpixel set, and output the driving signal, wherein:

each subpixel set comprises subpixels in different colors and at least two subpixels in an identical color, the second determination module is further configured to determine a second equivalent brightness reduction value corresponding to the voltage drop for each subpixel subset in the subpixel set, each subpixel subset including the subpixels in an identical color, and the target brightness calculation module is further configured to calculate a sum of the second equivalent brightness reduction value corresponding to each subpixel subset and the initial brightness value for each subpixel as the target brightness value for each subpixel in each subpixel subset.

8. The voltage drop compensation device according to claim 7, wherein the voltage drop $\Delta V_n$ for the power signal corresponding to an $n^{th}$ pixel set is calculated using an equation:

$$\Delta V_n = \begin{cases} \Delta V_{n-1} + R_n * \sum_{i=n}^{N} L_i / K & 2 \le n \le N \\ R_1 * \sum_{i=1}^{N} L_i / K & n = 1 \end{cases}, \text{ and}$$

wherein N represents the number of the subpixel sets, $\Delta V_{n-1}$ represents the voltage drop for the power signal corresponding to an $(n-1)^{th}$ subpixel set adjacent to the $n^{th}$ subpixel set and closer to the power signal input end, $R_n$ represents a resistance of a portion of the power line connected to the $n^{th}$ subpixel set, $L_i$ represents a brightness value for an $i^{th}$ subpixel set which is a sum of the brightness values for all subpixels in the subpixel set, and K represents a ratio of the brightness value for each subpixel to a driving current for each subpixel.

9. The voltage drop compensation device according to claim 7, wherein:

each subpixel comprises an Organic Light-Emitting Diode (OLED) and a driving thin film transistor (TFT) connected to the OLED, and the second determination module comprises:

a first unit configured to determine a first equivalent gate-to-source voltage $V_{GS}$ corresponding to each subpixel set;

a second unit configured to determine a first correspondence between a drain-to-source voltage $V_{DS}$ and a driving current $I_{DS}$ corresponding to the first equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the driving TFT;

a third unit configured to determine a first equivalent driving current reduction value corresponding to the voltage drop in accordance with the first correspondence; and a fourth unit configured to determine the first equivalent brightness reduction value in accordance with the first equivalent driving current reduction value.

10. The voltage drop compensation device according to claim 7 wherein:

each subpixel comprises an Organic Light-Emitting Diode (OLED) and a thin film transistor (TFT) connected to the OLED, and the second determination module comprises:

a first unit configured to determine a second equivalent gate-to-source voltage $V_{GS}$ corresponding to each subpixel subset;

a second unit configured to determine a second correspondence between a drain-to-source voltage $V_{DS}$ and a driving current $I_{DS}$ corresponding to the second equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the TFT;

a third unit configured to determine a second equivalent driving current reduction value for each subpixel subset corresponding to the voltage drop in accordance with the second correspondence; and a fourth unit configured to determine the second equivalent brightness reduction value for each subpixel subset corresponding to the voltage drop in accordance with the second equivalent driving current reduced value for each subpixel subset.

11. A display device, comprising the voltage drop compensation device according to claim 7.

12. The display device according to claim 11, wherein the voltage drop $\Delta V_n$ for the power signal corresponding to an $n^{th}$ pixel set is calculated using an equation:

$$\Delta V_n = \begin{cases} \Delta V_{n-1} + R_n * \sum_{i=n}^{N} L_i / K & 2 \le n \le N \\ R_1 * \sum_{i=1}^{N} L_i / K & n = 1 \end{cases}, \text{ and}$$

wherein N represents the number of the subpixel sets, $\Delta V_{n-1}$ represents the voltage drop for the power signal corresponding to an $(n-1)^{th}$ subpixel set adjacent to the $n^{th}$ subpixel set and closer to the power signal input end, $R_n$ represents a resistance of a portion of the power line connected to the $n^{th}$ subpixel set, $L_i$ represents a brightness value for an $i^{th}$ subpixel set which is a sum of the brightness values for all subpixels in the subpixel set, and K represents a ratio of the brightness value for each subpixel to a driving current for each subpixel.

13. The display device according to claim 11, wherein:

each subpixel comprises an Organic Light-Emitting Diode (OLED) and a driving thin film transistor (TFT) connected to the OLED, and the second determination module comprises:

a first unit configured to determine a first equivalent gate-to-source voltage $V_{GS}$ corresponding to each subpixel set;

a second unit configured to determine a first correspondence between a drain-to-source voltage $V_{DS}$ and a driving current $I_{DS}$ corresponding to the first equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the driving TFT;

a third unit configured to determine a first equivalent driving current reduction value corresponding to the voltage drop in accordance with the first correspondence; and a fourth unit configured to determine the first equivalent brightness reduction value in accordance with the first equivalent driving current reduction value.

14. The display device according to claim 11, wherein:

each subpixel comprises an Organic Light-Emitting Diode (OLED) and a thin film transistor (TFT) connected to the OLED, and the second determination module comprises:

a first unit configured to determine a second equivalent gate-to-source voltage $V_{GS}$ corresponding to each subpixel subset;

a second unit configured to determine a second correspondence between a drain-to-source voltage $V_{DS}$ and a driving current $I_{DS}$ corresponding to the second equivalent gate-to-source voltage $V_{GS}$ in accordance with a pre-recorded correspondence among a gate-to-source voltage $V_{GS}$, the drain-to-source voltage $V_{DS}$ and the driving current $I_{DS}$ of the TFT;

a third unit configured to determine a second equivalent driving current reduction value for each subpixel subset corresponding to the voltage drop in accordance with the second correspondence; and a fourth unit configured to determine the second equivalent brightness reduction value for each subpixel subset corresponding to the voltage drop in accordance with the second equivalent driving current reduced value for each subpixel subset.

15. A voltage drop compensation method for a display panel, the display panel comprising a power line connected to a power signal input end and a plurality of subpixels connected to the power line and driven simultaneously, the plurality of subpixels being segmented into at least two subpixel sets without any intersection in an ascending order of distances between the subpixels and the power signal input end, the voltage drop compensation method comprising steps of:

determining a voltage drop for a power signal corresponding to each subpixel set;

determining a first equivalent brightness reduction value corresponding to the voltage drop;

calculating an initial brightness value for each subpixel in the subpixel set;

calculating a sum of the first equivalent brightness reduction value corresponding to the subpixel set and the initial brightness value as a target brightness value for each subpixel in the subpixel set; and generating a driving signal for each subpixel in accordance with the target brightness value for each subpixel in the subpixel set, and outputting the driving signal, wherein:

each subpixel includes an Organic Light-Emitting Diode (OLED) and a driving thin film transistor (TFT) connected to the OLED; and the step of determining the first equivalent brightness reduction value corresponding to the voltage drop comprises:

determining a first equivalent gate-to-source voltage VGS corresponding to each subpixel set, determining a first correspondence between a drain-to-source voltage VDS and a driving current IDS corresponding to the first equivalent gate-to-source voltage VGS in accordance with a pre-recorded correspondence among a gate-to-source voltage VGS, the drain-to-source voltage VDS and the driving current IDS of the driving TFT, determining a first equivalent driving current reduction value corresponding to the voltage drop in accordance with the first correspondence, and determining the first equivalent brightness reduction value in accordance with the first equivalent driving current reduction value.

16. The voltage drop compensation method according to claim 15, wherein the first equivalent gate-to-source voltage VGS is an average of the gate-to-source voltages of all subpixels in the subpixel set.

* * * * *